United States Patent [19]

De Buyer

[11] Patent Number: 4,823,818

[45] Date of Patent: Apr. 25, 1989

[54] DISPENSING DEVICE FOR WASHING PRODUCTS FOR A DISHWASHING MACHINE

[75] Inventor: Edouard De Buyer, La Celle Saint Cloud, France

[73] Assignee: Colgate-Palmolive Company, Piscataway, N.J.

[21] Appl. No.: 86,438

[22] Filed: Aug. 17, 1987

[30] Foreign Application Priority Data

Aug. 20, 1986 [FR] France ..... 86 11894

[51] Int. Cl.[4] ..... A47L 15/44

[52] U.S. Cl. ..... 134/95; 222/255; 222/309; 222/386

[58] Field of Search ..... 134/94, 95, 99; 68/17 R; 222/252, 255, 309, 383, 386

[56] References Cited

U.S. PATENT DOCUMENTS

| | | | |
|---|---|---|---|
| 1,615,413 | 1/1927 | Snyder | 68/17 R |
| 2,703,191 | 3/1955 | Jernander | 222/255 |
| 2,914,217 | 11/1959 | Warhus | 68/17 R X |
| 2,997,047 | 8/1961 | Anderson | 68/17 R X |
| 3,207,373 | 9/1965 | Dannenmann | 68/17 R X |
| 3,606,086 | 9/1971 | Drummond et al. | 222/309 X |

FOREIGN PATENT DOCUMENTS

| | | | |
|---|---|---|---|
| 128073 | 12/1984 | European Pat. Off. | 68/17 R |
| 2611493 | 9/1977 | Fed. Rep. of Germany . | |
| 3037151 | 4/1982 | Fed. Rep. of Germany . | |
| 946383 | 6/1964 | France . | |

*Primary Examiner*—Philip R. Coe

*Attorney, Agent, or Firm*—Richard J. Ancel; Murray M. Grill; Robert C. Sullivan

[57] ABSTRACT

This dispensing device for washing products for a dishwashing machine, comprising a tank (30) provided with a door or a cover and means for projecting water and washing products on the articles to be washed, is characterized in that it includes a manually operated first means (3, 4, 6) for injecting into the tank (30) a given quantity of washing products for setting the concentration of a washing bath at the start of the service and a second means (8, 9, 11) of regulating the concentration by injecting a given quantity of washing products during each cycle and during the whole washing period, the second means (8, 9, 11) being operated mechanically by the action of closing the door or the cover of the machine through the intermediary of a suitable transmission system (12, 35).

7 Claims, 2 Drawing Sheets

DISPENSING DEVICE FOR WASHING PRODUCTS FOR A DISHWASHING MACHINE

The subject of the present invention is a dispenser for washing products for a dish-washing machine and more particularly for a commercial washing machine of fixed basket type.

Commercial dish-washing machines of the fixed basket type comprise a tank provided with a door or a cover allowing the introduction of the basket containing the articles to be washed and, inside the said tank, nozzles for injection of water under pressure.

To ensure an efficient wash, at the start of the service, a given quantity of washing products is injected into the washing bath so as to set the concentration of the bath. On the other hand, between each washing cycle, that is after each introduction of a new basket, a new quantity of washing products is injected in order to regulate the concentration of the washing bath.

In general, the injection of the quantities of washing products is carried out by means of a dispenser.

This dispenser can be manually operated by the user at the beginning of the service for setting the concentration of the bath and also periodically for a whole number of cycles, in order to regulate this concentration during the washing. However, this type of manual operation leads to not very accurate quantities, because it depends on the operator.

Moreover, dispensers are also known which are automatically activated between each cycle and on refilling by a suitable control system in order to inject the quantity of products, previously determined, necessary for regulating and setting the concentration of the bath. This control system can be either hydraulic, which is not always easy to install, nor is it even accurate, or electri, which is expensive as regards materials and installation, and indeed is not very accurate.

The aim of the present invention is therefor to put forward a dispenser which is of simple design, reliable, easy to operate and which can be adapted with the minimum of adjusted, without risk of getting out of adjustment, to the washing conditions of the washing machine, that is, to the characteristics of the machine and to the types of dirt on the articles to be washed.

To this effect, the subject of the present invention is a dispenser for washing products for a dish-washing machine, particularly for a washing machine of the fixed basket type, comprising a tank provided with a door or a cover and means for projecting water and washing products on to the items to be washed, characterized in that it contains a primary means for manually operating the injection into the tank of a given quantity of washing products for setting the concentration of the washing bath at the start of the service and a second means for regulating the said concentration by injecting a given measure of washing products during each cycle and during the whole washing period, the said second means being mechanically activated by the action of closing the door or the cover of the machine by the intermediary of a suitable transmission means.

According to another characteristic, the means for setting the concentration and the means for regulating are each fitted with a device for adapting the quantities of washing products to be injected to the characteristics of the machine and to the types of dirts deposited on the articles to be washed.

The invention will be better understood with the help of the description which follows, given only as an example and made with reference to the attached drawings, on which:

Figure 1:
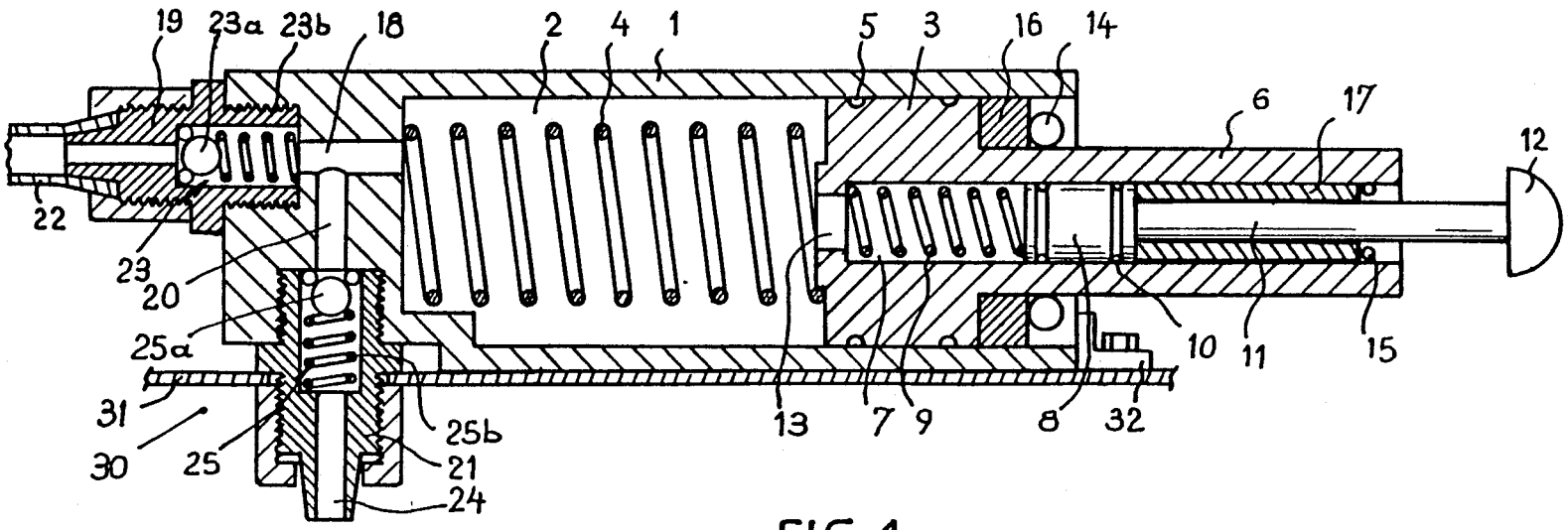
FIG. 1 is a view in longitueinal section of the dispenser according to the invention.

First of all referring to FIG. 1, it can be seen that the dispenser comprises a pump body 1 which houses an inner chamber 2 in which a main piston 3 moves, returned by a spring 4 which presses on one side on the said piston and on the other side on the bottom of the internal chamber 2. The seal between the pump body 1 and the main piston 3 is ensured by sealing joints 5.

The main piston 3 is hollow and is extended by a tube 6 of smaller diameter which extends to the outside of the pump body 1. The main piston 3 and the tube 6 serve as a second pump body and in which is formed a small inner chamber 7 in which a secondary piston 8 slides, returned by a spring 9 which presses on one side on the said secondary piston 8 and on the other side on the base of the small chamber 7. The seal between the main piston 3 and the secondary piston is ensured by sealing joints 10.

The secondary piston 8 is extended by a rod 11 of smaller diameter which extends to the outside of the tube 6. The end of the rod 11 opposite to the secondary piston 8 is provided with an operating button 12.

The main chamber 2 communicates with the secondary chamber 7 by an aperture 13 provided in the main piston 3.

The travel of the main piston 3 and of the secondary piston 8 are restricted by end stops, 14 and 15 respectively.

Moreover, the travel of the pistons 3 and 8 can be regulated mechanically so as to adapt the volume of the chambers 2 and 7, that is the quantity of the washing product to be injected, to the characteristics of the machine and to the types of dirt deposited on the dishes to be washed.

To this effect, a spacing ring 16 is mounted on the tube 6 between the main piston 3 and the end stop 14. The spacing ring 16 can be more or less thick so as to modify the travel of the main piston 3 which allows the volume of the chamber 2 to be adjusted.

In the same way, a spacing ring 17 is threaded on the rod 11 between the secondary piston 8 and the end stop 15, which allows the travel of the secondary piston 8 to be modified, according to the thickness of the said spacing ring 17, and consequently the volume of the small chamber 7 to be adjusted.

The main chamber 2 communicates by a small duct 18 with an admission nozzle 19 and by a small duct 20 with a delivery nozzle 21.

The admission nozzle 19 screwed into the pump body 1 is connected to a reservoir of washing products, not represented, by a pipe 22 and includes a non-return valve 23 comprising in the normal way a ball **23*a* and a spring 23*b*. The non-return valve 23** opens on suction and closes on delivery.

The delivery nozzle 21 screwed into the main body 1, perpendicular to the axis of the piston 3 and 8, has its outlet 24 opening into the tank 30 of the dishwashing machine. This nozzle 21 enables the pump body 1 to be fixed to the side 31 of the dishwashing machine, the said pump body 1 also having two other fixing points constituted by small feet 32. The delivery nozzle 21 for the washing product includes a non-return valve 25 constituted by a ball 25*a* and a spring 25*b*. This valve 25 opens on delivery and closes on admission.

The dispenser thus described functions in the following way.

Figure 2:
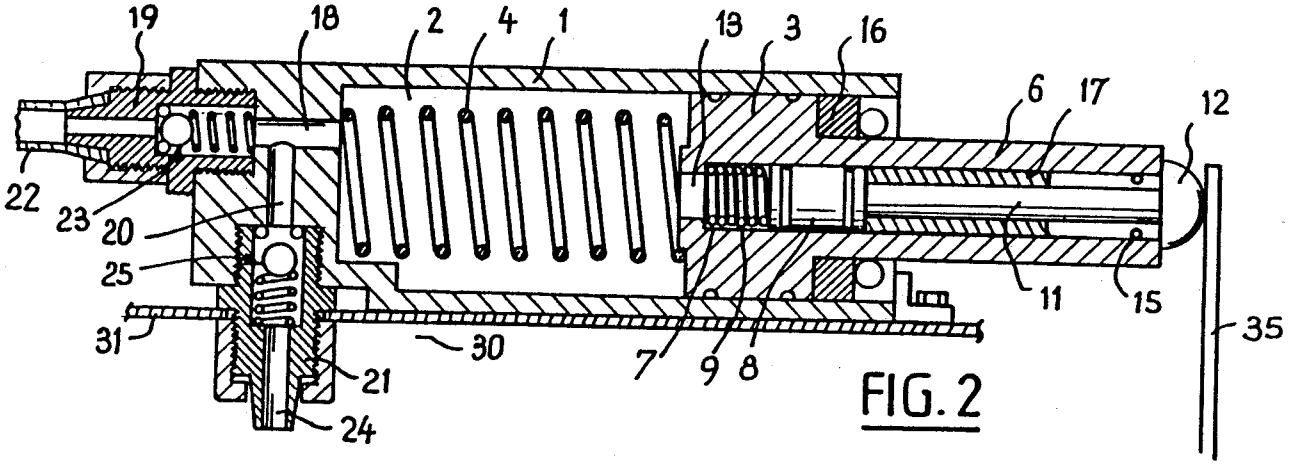
FIG. 2 is a sectional view of the dispenser showing the injection of a quantity of the product during a washing cycle.
Figure 3:
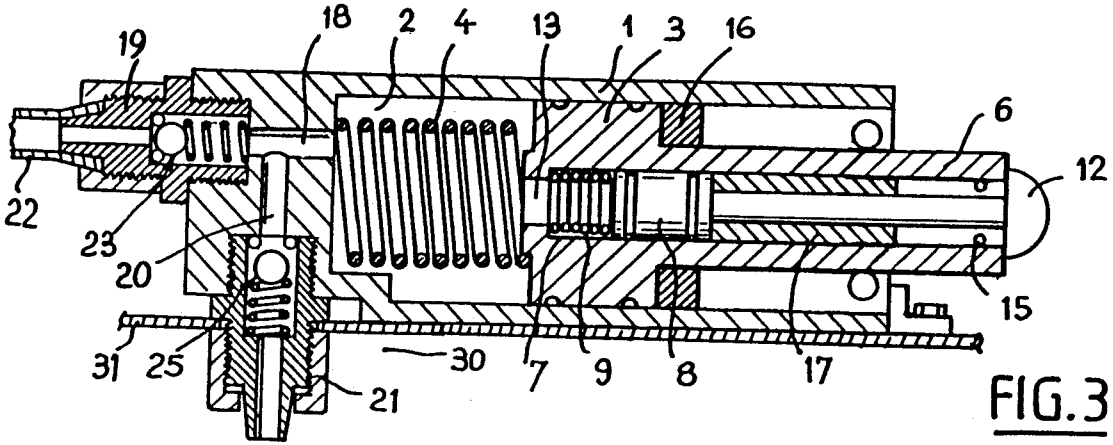
FIG. 3 is a sectional view of the device showing the injection of a quantity of the product at the start of the service.

First of all, to fill the chambers 2 and 7 with washing products, the user presses an operating button 12, which has the effect of driving in the secondary piston 8 and compressing the spring 9 (FIG. 2). The user continuing his movement, the operating button 12 comes into contact with the end of the tube 6, which causes the displacement of the main piston 3 while compressing the spring 4 (FIG. 3).

Once the spring 4 is compressed, the user releases the operating button and by the action of the springs 4 and 9, the pistons 3 and 8 take up their initial position again. The suction thus created by the pistons 3 and 8 causes the opening of the non-return valve 23 of the admission nozzle 20 and the arrival of the washing product which fills the chambers 2 and 7.

When the machine is started, the user must inject into the tank 30 of the machine a given quantity of washing products in order to set the concentration of the washing bath. This quantity for setting the concentration corresponds to the volume of liquid contained in the chambers 2 and 7.

Accordingly, as before, the user presses the operating button 12 to displace in succession the secondary piston 8 and the main piston 3, thus causing the opening of the non-return valve 25 and the injection of the washing product into the tank 30 to set the concentration of the washing bath. As soon as the user no longer exerts pressure on the operating button 12, the springs 4 and 9 allow the automatic priming of the product and the refilling of the chambers 2 and 7.

Furthermore, between each washing cycle, that is after each introduction of a new basket, a new quantity of washing products must be injected into the tank 30 in order to regulate the concentration of the washing bath. In order to change the basket, the user opens then closes the door or cover of the machine. This door or cover includes for example a small finger 35 (FIG. 2) which acts on the operating button 12. On closing the cover or the door, the small finger 35 pushes in the operating button 12, which has the effect of displacing the piston 8 and compressing the spring 9. The product contained in the chamber 7 passes into the chamber 2 by the aperture 13. Under the effect of the increase in volume in the chamber 2, the non-return valve 25 opens and the quantity of products corresponding to the volume of the chamber 7 is injected into the tank to regulate the concentration of the washing bath between each cycle. The travel of the door or the cover coincides with the travel which the secondary piston 8 must have.

On opening the door or cover, the finger 35 releases the operating button 12 and the spring 9 takes the secondary piston 8 into its initial position. The non-return valve 23 opens and the product fills up the secondary chamber 7 again.

The device is ready for the injection of a new quantity.

As an example, the main pump body 1 permits the injection at the most of 120 $cm^3$ of washing products by steps of 10 $cm^3$. The adjustment system constituted by the spacing ring 16 enables in effect the injecting of any volume between 10 $cm^3$ and 120 $cm^3$ by steps of 10 $cm^3$. The main piston 3 has a travel of 60 mm and each spacing ring 16 has a thickness of 5 mm, the piling up of the suitable number of spacing rings thus enabling the reduction of the travel of the piston and the injection of the volume of the product necessary for setting the concentration of the tank.

The secondary pump body constituted by the main piston 3 and the tube 6 enables the injection, thanks to the adjustment system formed by the spacing rings 17, of any volume between 1 $cm^3$ and 12 $cm^3$ by steps of 1 $cm^3$. The secondary piston 8 has a travel of 60 mm and each spacing ring has a thickness of 5 mm, the piling up of the suitable number of spacing rings thus enabling the reduction of the travel of the piston and the injection of the volume of washing products necessary for maintaining the concentration during the washing period.

This dispenser, which is self-priming and cannot lost its priming therefore uses simultaneously the energy of the operator and the fact that closing the cover or the door of the machine activates the secondary piston by a suitable means of transmission. Moreover, thanks to this arrangement, the reliability can be increased in comparison with the known system, by reducing the number of handlings and the risk of mishandlings. Finally, it enables the cost of purchasing and maintenance to be reduced.

I claim:

1. A dispenser of washing products for a dishwashing machine of a fixed basket-type having a door and operating during a full washing period, including several washing cycles, said dishwasher having a tank provided with a door, and means for projecting washing products into the tank, said dispenser including a manually operated first means for injecting into said tank from said projecting means a given quantity of washing products for setting the concentration of a washing bath at the start of said washing period, and a second means for regulating said concentration by injecting from said projecting means a given quantity of washing products during each said cycle and during said full washing period, said second means being operated mechanically by the action of closing said door through the intermediary of a transmission system.

2. A dispenser according to claim 1, wherein said means for setting and the means for regulating the concentration are each provided with means for adjustment to adapt the quantities of washing products to be injected to the characteristics of the machine into the types of dirts deposited on the articles to be washed.

3. A dispenser according to claim 2, wherein said means for setting the concentration includes a pump body and a main piston capable of moving to and fro in said body, said piston itself being a pump body in which a secondary piston, which is the means for regulating, moves to and fro.

4. A dispenser according to claim 3, wherein said main piston and said secondary piston operate successively for setting the concentration, and only said secondary piston operates for regulating said concentration.

5. A dispenser according to claim 4, wherein said means for adjustment of the means for setting and the means for regulating the concentration includes spacing rings contacting said main and secondary pistons to enable the travel of said main and secondary pistons to be reduced independently.

6. A dispenser according to claim 5, wherein said main piston and said secondary piston are each returned by a spring and are blocked by end stops against which said spacing rings make contact.

7. A dispenser according to claim 6, wherein said first pump body is fixed onto said washing machine by a nozzle for injecting the washing product into said dishwasher and by at least two small feet.

* * * * *